United States Patent [19]

Kuriiwa

[11] Patent Number: 4,747,334

[45] Date of Patent: May 31, 1988

[54] OCEAN LAUNCHING APPARATUS OF SPACE ROCKET

[75] Inventor: Tsuneaki Kuriiwa, Chiba, Japan

[73] Assignees: Sankyu Inc., Fukuoka; Mitsubishi Jukogyo Kabushiki Kaisha, Tokyo, both of Japan

[21] Appl. No.: 24,562

[22] Filed: Mar. 11, 1987

[30] Foreign Application Priority Data

Mar. 12, 1986 [JP] Japan ..... 61-54415

[51] Int. Cl.[4] ..... F41F 3/04

[52] U.S. Cl. ..... 89/1.802; 114/259; 114/260

[58] Field of Search ..... 89/1.810, 1.809, 1.8, 89/1.815, 1.801, 1.802; 114/259, 260, 1

[56] References Cited

U.S. PATENT DOCUMENTS

| | | | |
|---|---|---|---|
| 2,735,391 | 2/1956 | Buschers | 89/1.802 |
| 2,984,157 | 5/1961 | Johnstone | 89/1.802 |
| 3,122,057 | 2/1964 | Kubit | 89/1.810 |
| 3,135,162 | 6/1964 | Kamalian | 89/1.810 |
| 3,403,652 | 10/1968 | Hardy | 114/259 |
| 4,075,860 | 2/1978 | Hansen | 114/259 X |
| 4,147,123 | 4/1979 | Kirby et al. | 114/260 |
| 4,312,287 | 1/1982 | Kuo | 114/259 |
| 4,465,012 | 8/1984 | Bos | 114/259 X |

OTHER PUBLICATIONS

"How to Handle 24-Megaton Thrust", in Missiles and Rockets, Jun. 1959, Chauncy J. Hamlin, Jr., pp. 16–18.

"See Launch Studied for Space Vehicles", Larry Booda, in Aviation Week, Dec. 1960, vol. 73, No. 24, pp. 69, 73, 75 and 79.

"Vertical Floating Launch of Rocket Vehicles", J. E. Draim & C. E. Stolzer in Aerospace Engineering, vol. 20, No. 6, Jun. 1961, pp. 12, 13, 46–49, 52 & 53.

*Primary Examiner*—David H. Brown

*Attorney, Agent, or Firm*—Robbins & Laramie

[57] ABSTRACT

An ocean launching apparatus of space rockets comprises a launch pad platform having a floating-island structure and a semi-submersible hull for loading and transporting the launch pad platform. When the apparatus reaches an intended ocean area, a rocket set on the launch pad platform is floated from the hull in a semi-submersing state on the ocean together with the launch pad platform and moved to a launching site. In this way, it is possible to provide an ideal launching site of space rockets, increase an economical efficiency of launching of space rockets, and guarantee the safety if an accident should occur.

10 Claims, 6 Drawing Sheets

OCEAN LAUNCHING APPARATUS OF SPACE ROCKET

BACKGROUND OF THE INVENTION

1. Field of the Invention

The present invention relates to a movable ocean launching system which is capable of launching a space rocket at an optimum location.

2. Description of the Prior Art

It has been considered that sites that would be ideal for launching geostationary satellites include sites located on the equator. When many space stations which are expected to be launched in the future and take low altitude orbits on the equator are considered, ideal gateways to space on the earth include the equatorial area on the Pacific Ocean. However, present launch sites of large size space rockets such as Tanegashima (at a latitude of 30° North) of the National Space Development Agency of Japan, and Cape Canaveral (at a latitude of 28° North) of the National Aeronautics and Space Administration of U.S.A. cannot be said to be ideal, though French Kourou (at a latitude of 5° North) of CNES, France is a fairly ideal site. Furthermore, there is no island having a suitable size in the equatorial area of the Pacific Ocean.

At any rate, if in the future the locations of space rocket-launching bases are limited to land areas, there are many limitations with respect to the rights of neighboring residents, protection of the environment, guarantees as to the safety of areas surrounding the base and the sites where rockets are to fall, and so forth. Thus it will become increasingly difficult to obtain suitable locations anywhere in the world.

These days, however, we have reached the stage where the demand for the launching of new or substitute space rockets is constantly rising. This not only applies to the demand for more and more satellites to be launched, but there is also an uncoming need to launch materials and machine parts for the construction of space stations, beginning with the No. 1 space station on which work is planned to start in 1992. It is, therefore, expected that the demand will continue to increase as the commercial potential for the employment of space is realized.

It can, therefore, be said that the appearance of a movable launching system for space rockets which replaces the present land-based launching sites that are so difficult to locate would be extremely significant as such as a system would make it possible to freely select an optimum launch site, as well as greatly increasing the launching capacity and reducing the cost of launching by allowing for continuous launching.

SUMMARY OF THE INVENTION

It is an object of the present invention to provide an ocean launching apparatus for space rockets which is capable of replacing the land launching sites for space rockets which are so difficult to locate, allows optimum launching sites to be freely selected, and employs a movable launching complex.

The object of the present invention is achieved by an ocean launching apparatus for space rockets of the kind described in claim 1.

In the present invention, a movable rocket-launching complex is loaded on a carrier and carried to an intended launching area on the ocean where rockets are to be launched. Thus optimum launching sites can be freely selected, unlike with land launching systems, and there would be little danger if an accident should occur as the location would be in the middle of the ocean. Specifically, the present invention solves the difficulty of finding suitable locations for land-based launching sites and removes the present limitations on the provision of launching capacity in response to demand.

DESCRIPTION OF THE PREFERRED EMBODIMENTS

Figure 1:
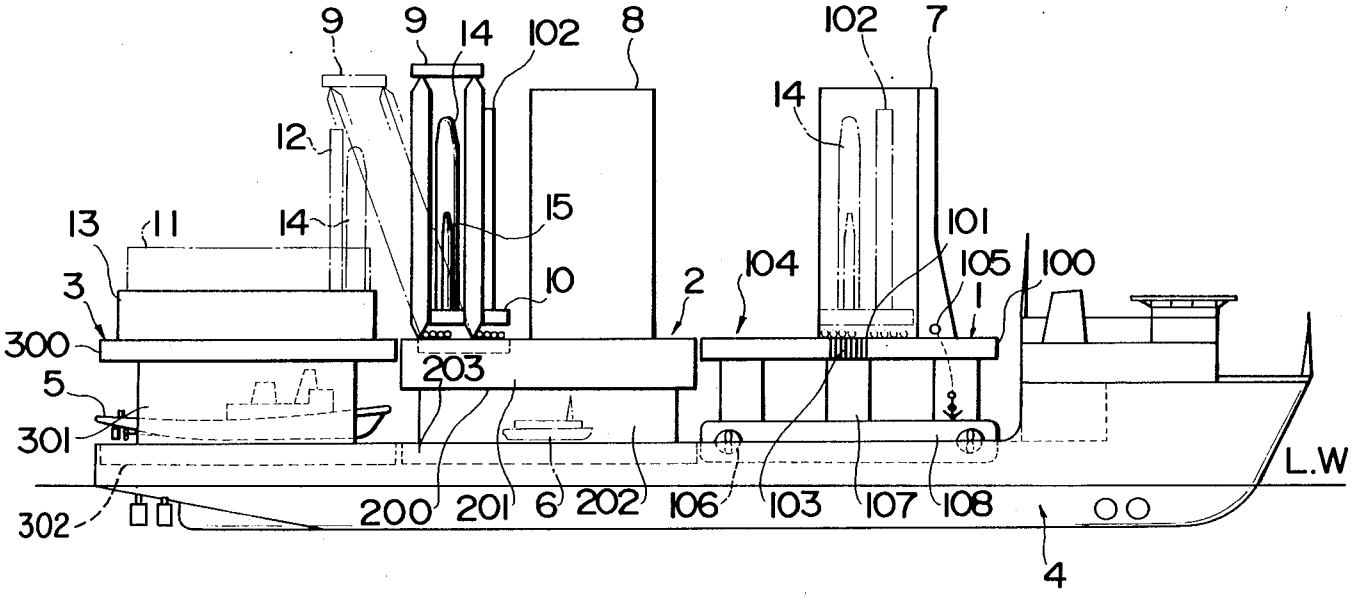
FIG. 1 is a side view of a carrier to which the present invention relates in a state wherein a rocket launching complex is loaded thereon.
Figure 2:
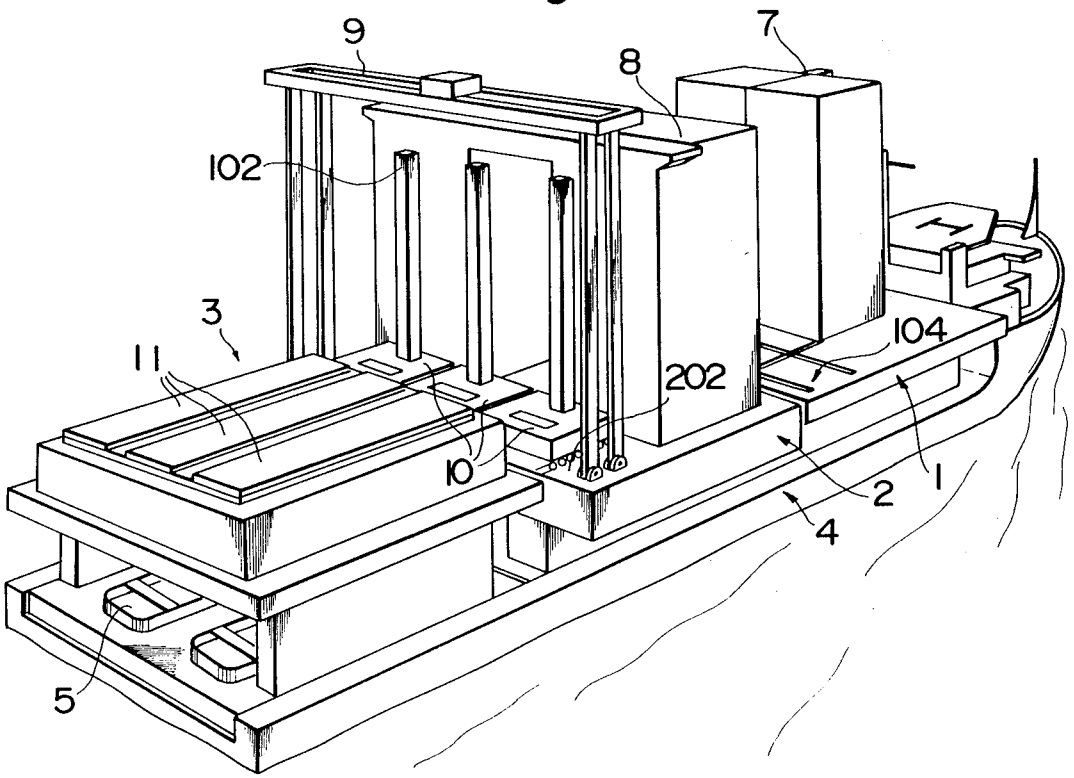
FIG. 2 is a perspective view of the same.
Figure 3:
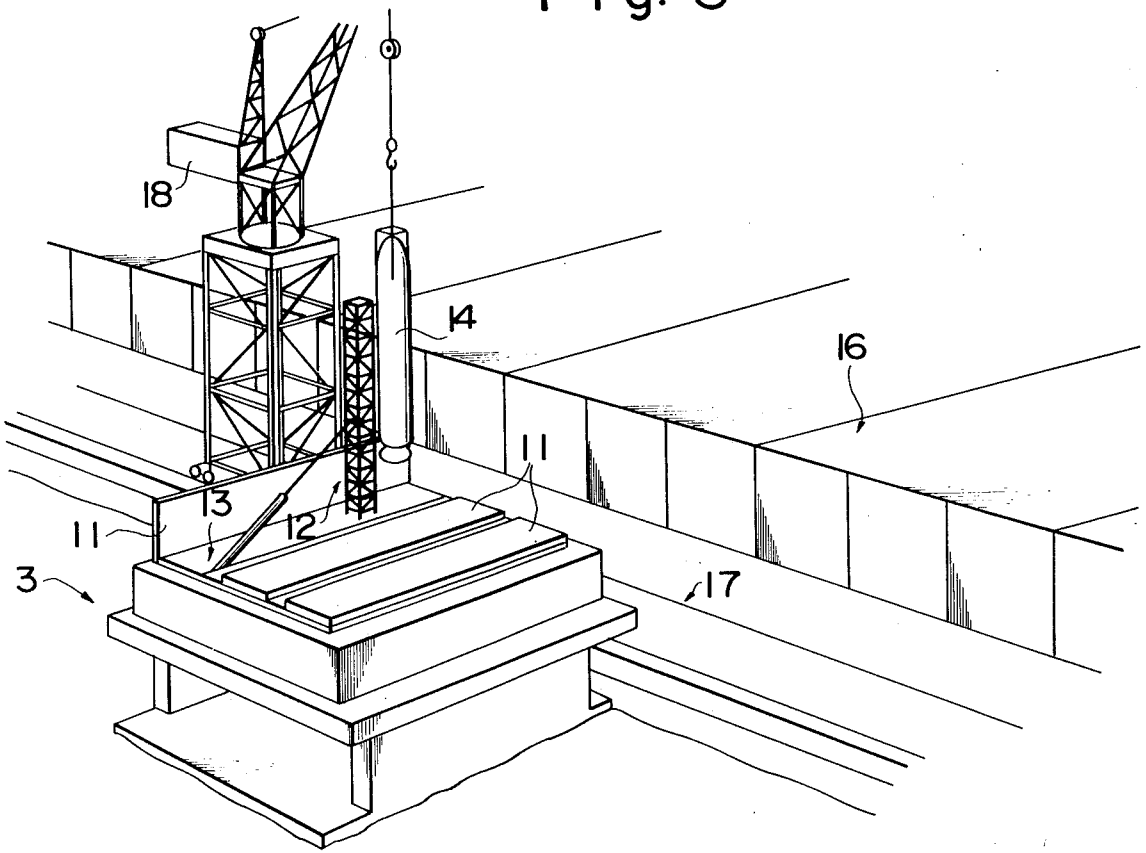
FIG. 3 is a perspective view showing the loading process in a loading berth.

The arrangement of the present invention is described on the basis of FIGS. 1 to 3. Reference number 1 denotes a launch pad platform which has the structure of a floating island to allow it to float on the surface of the sea. Reference number 2 denotes a vehicle assembly building platform for servicing a rocket during launching and which has the same floating-island structure. Reference number 3 denotes a hangar platform for safely maintaining a rocket during transportation whereby the platform also has the floating-island structure. A movable launch complex for space rockets comprises the launch pad platform 1, the vehicle assembly building platform 2, and the hangar platform 3. Reference number 4 denotes a carrier employed for carrying the above-described launch pad platform 1, vehicle assembly building platform 2, and hangar platform 3 when loaded thereon. Reference number 16 denotes the above-described rocket-loading berth which is provided at a harbor; reference number 17, a loading quay; and reference number 18, a crane.

The launch pad platform 1 comprises a main deck 100 on which are provided a launch pad 101 disposed in the vicinity of a rocket-launching position, an umbilical tower 102 standing in the vicinity of the launch pad 101, a pad service tower 7 standing in parallel with the umbilical tower 102, and a movable launch turnout 104 for rockets. A flame deflector 103 is provided at the lower portion of a rocket 14 which is installed on the main deck 100 of the launch pad platform 1 and support machine houses are provided in other spaces. A plurality of struts 107 are fixed to the under portion of the main deck 100 and floats 108 are provided below the struts 107. These floats 108 are provided with dynamic positioning systems (not shown in the drawings).

The vehicle assembly building platform 2 comprises a vehicle assembly building 8 provided on a main deck 200 thereof, a rocket crane 9 for setting the rocket 14 on a mobile launcher 10, and a mobile launcher park 202 for collecting the mobile launcher 10 on which the rocket 14 is set. A block house 201 is disposed on the main deck 200, and a control center, a power station, and accommodations (not shown) are accommodated therein. Two web-formed struts 202 are provided at the lower portion of the main deck 200 and floats 203 are provided at the ends thereof. The vehicle hangar platform 3 comprises a main deck 300 on which are positioned a plurality of vehicle hangars 13, a moving support 12 for loading the rocket 14 thereon in the VH 13, and a hatch cover 11 of the vehicle hangar 13 are loaded, two web-formed struts 301 being provided at the lower portion of the deck 300, and floats 302 being provided at the respective ends thereof.

The carrier 4 (Ocean Launch Complex Carrier) serves as an ocean rocket launching base and represents a system that enables the simultaneous loading and transportation of the above-described three platforms. In other words, the carrier comprises a float-on/float-off system, deep sea mooring equipment, dynamic positioning system, and a set of other equipments required for this type of vessel. If necessary, it is possible to dispose all or parts of the accommodation rooms, the block house, and the control center on the carrier. Other systems include a solid rocket booster carrier (not illustrated) which enables the safe loading and transportation of the relevant solid rockets. A set of equipment which would be required for this type of vessel is provided on the carrier. A propellant supply ship (not illustrated) is adapted for safely loading and transporting rocket propellants such as liquefied hydrogen, liquified oxygen, and so on, and for supplying them to the rocket at the launching site. In addition, the carrier is provided with a ship for loading and transporting nitrogen and helium and supplying them to a rocket satellite at the launching site, as well as a set of equipment required for this type of ship. A satellite supply ship (not illustrated) serves the function of safely loading and transporting a satellite to the launching area on the ocean and a set of equipment required for this type of ship is provided on the carrier. The satellite may be transported by storing it on the vehicle assembly building platform or the hangar platform. A tug boat 5 serves the function of supporting the float on/float off operation of the launch pad platform 11 and moving and positioning the launch pad platform 1 and ships in the ocean launching area; a set of other equipment required for this type of ship is provided on the carrier. A passenger boat 6 serves the function of embarking required workers who move between the carrier 4 and the launch pad platform 1 on the ocean launching area; a set of other equipment required for this type of vessel is provided on the carrier.

Description is made of the structure of each of the platforms 1, 2, and 3. The respective platforms 1, 2, 3 have the structure of a floating island having a floating body which can float on the surface of the sea. The platforms can be loaded on and unloaded from the loading deck of the floating dock-type carrier 4 by a float on/float off method. The main decks 100, 200, 300 of the platforms 1, 2, 3 are at the same level in the state of being loaded so as to allow the mobile launcher 10 to move across the launch pad platform 1 and the vehicle assembly building platform 2. A tunnel is provided at the under portion of the vehicle hangar platform 3 and the vehicle assembly building platform 2 so as to enable the storage of the tug boat 5 and the passenger boat 6. The float on/float off operation of only the launch pad platform 1 on the carrier 4 can be performed in the state wherein the vehicle hangar platform 3 and the vehicle assembly building platform 2 remain loaded. In addition, the float on/float off operation of the tug boat 5 and the passenger boat 6 can be performed in the state wherein all the platforms 1, 2, and 3 remain loaded. The launch pad platform 1 is formed into a semi-submersible type with a view to reducing the effects of waves during the launching operation.

Figure 4:
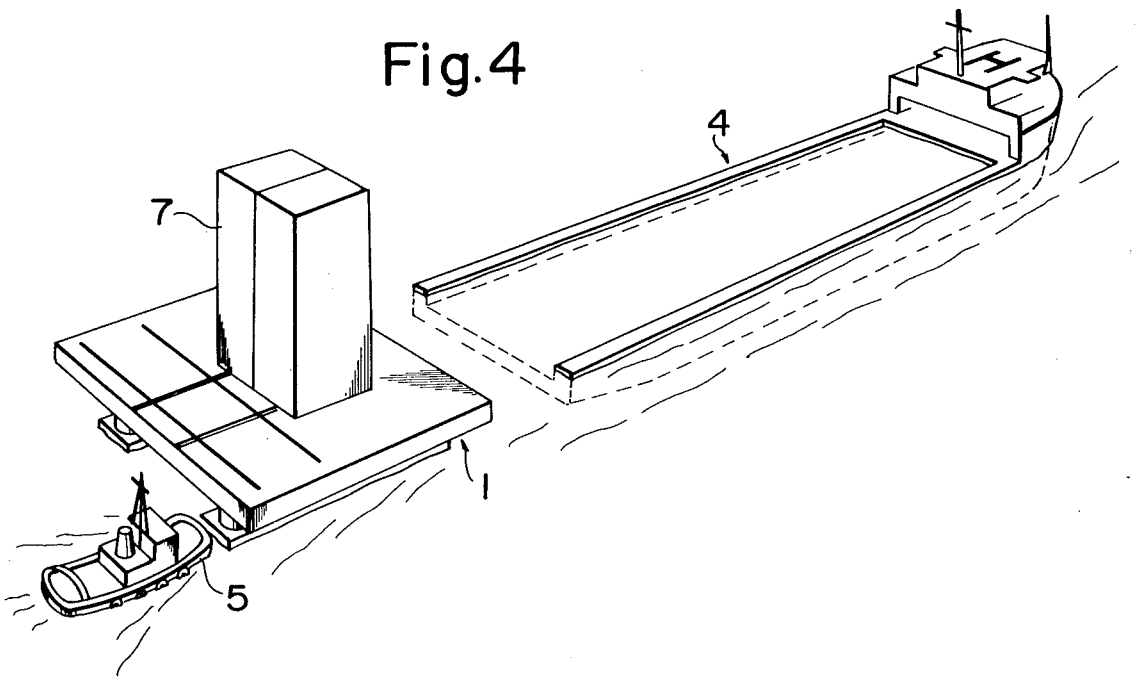
FIG. 4 is a perspective view showing the process of loading a rocket-launching complex on the carrier.

Description will be made of functions of the apparatus. The rocket 14 is loaded on the vehicle hangar platform 3 by the process shown in FIG. 3. Namely, the rocket 14 is sailed around the loading quay 17 of a rocket manufactory, the hatch cover 11 of the hangar 13 of the mooring vehicle hangar platform 3 is opened so that the moving support 12 is erected, the rocket 14 is held by the support 12 by using the shore crane 18 and accommodated in the hangar 13, and then the hatch cover 11 is closed so that the rocket 14 is protected from any damage during the voyage. Each of the platforms 1, 2, 3 is loaded on the carrier 4 by the process shown in FIG. 4. Namely, the launch pad platform 1, the vehicle assembly building platform 2, and the vehicle hangar platform 3 loaded with the rocket 14 are loaded in this order on the OLC carrier 4 which moors in a loading area provided at a harbor or an offshore area by the float on method. After all the platforms 1, 2, 3 have been loaded, the carrier is sunk until the vehicle hangar platform 3 and the vehicle assembly building platform 2 reach a given depth so that the tug boat 5 and the passenger boat 6 are loaded on thereon by the float on method. The state wherein the loading completed is shown in FIG. 2 and the carrier 4 is headed toward an intended ocean area after all the platforms 1, 2, 3, the tug boat 5, and the passenger boat 6 have been loaded thereon.

Figure 5:
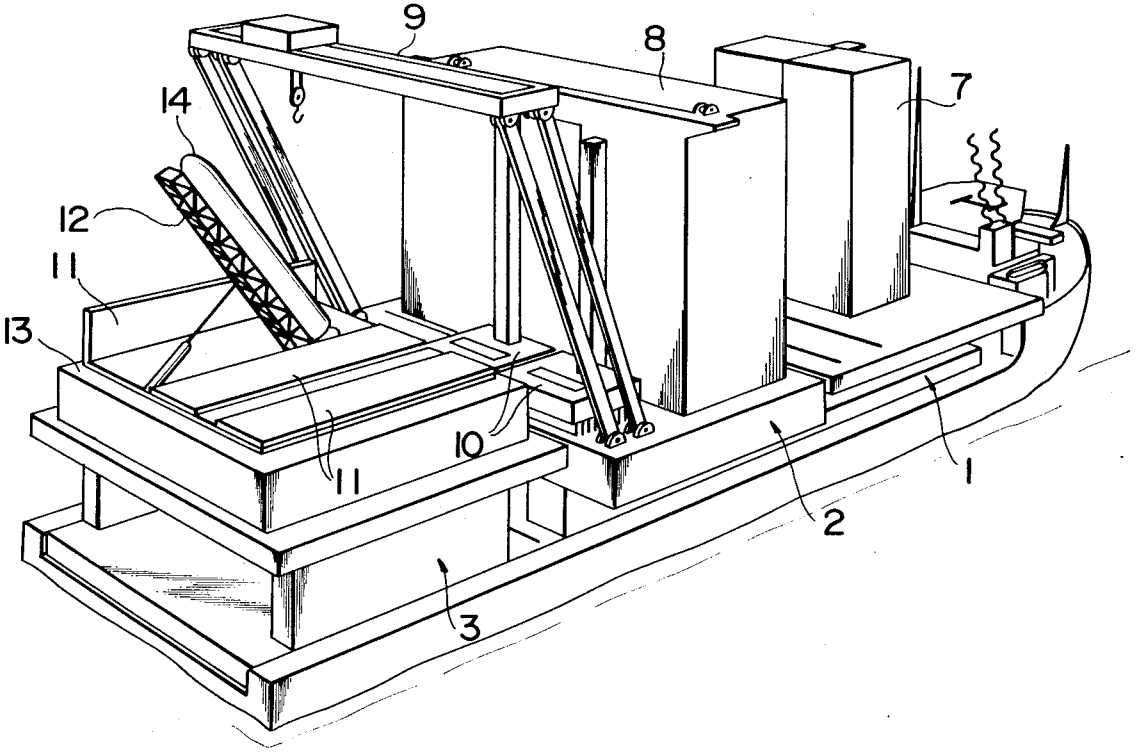
FIG. 5 is a perspective view showing the process of preparing for launching in an intended ocean launching location.
Figures 6, 7:
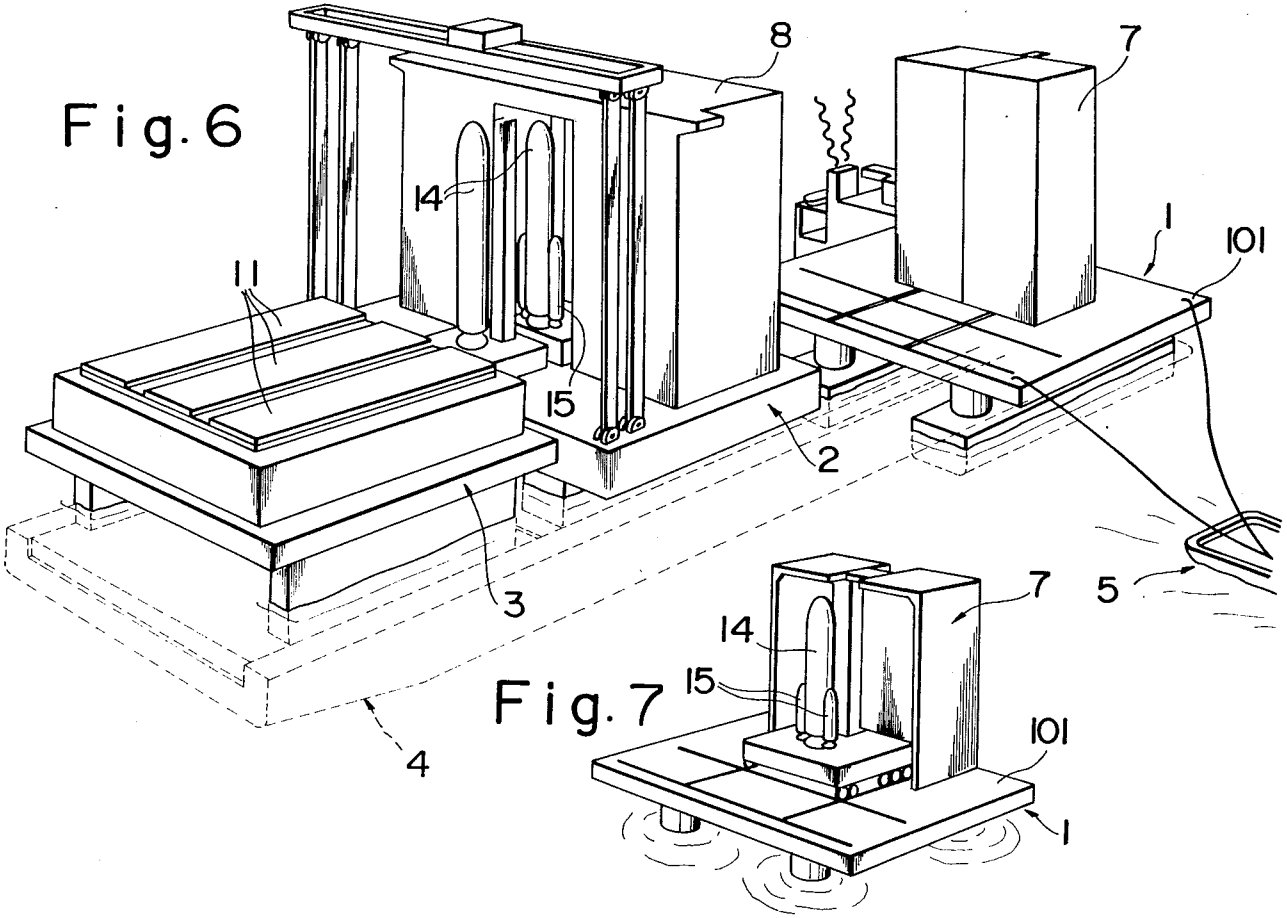
FIG. 6 is a perspective view showing part of the same process following that shown in FIG. 5.
FIG. 7 is a perspective view showing the state of the launch pad platform immediately before launching in the intended launching location.

When the carrier 4 reaches the intended ocean area, as shown in FIG. 5, the tug boat 5 and the passenger boat 6 are floated off and then one of the hatch covers 11 of the hangar 13 of the vehicle hangar platform 3 is first opened so that the moving support 12 is erected and the rocket 14 supported thereby is erected. The rocket 14 is suspended by operating the rocket crane 9 and is fixed to the mobile launcher 10 which is set on the center line of the vehicle assembly building platform 2. The shutter at the entance (on the vehicle assembly building platform 3 side) of the VAB Plat 2 is opened and the mobile launcher 10 is moved into the vehicle assembly building platform 2. After the mounting of the solid rocket 15 and other servicing operations have been completed on the vehicle assembly building platform 2, the shutter at the entrance on the opposite side thereof (on the launch pad platform 1 side) is opened so that the mobile launcher 10 is moved onto the launch pad platform 1 and set on a launch pad. The mobile launcher 10 is surrounded by the pad service tower 7, the satellite is mounted on the rocket (in some cases, the satellite is mounted on the rocket in the vehicle assembly building platform 2), and preparation for launching such as necessary inspections, and so on, is made. After the mounting of the satellite on the rocket 14 and the necessary inspections have been completed, as shown in FIG. 6, only the launch pad platform 1 is floated off from the carrier 4 and then transported to an intended launching site by the tug boat 5. The launch pad platform 1 transported to the launching site is moored in a semi-submerging state in order to minimize the shaking by waves, and if necessary, it is kept at a given position by the dynamic positioning system, as shown in FIG. 7.

After the final inspection, the pad service tower 7 is released, the prepared rocket 14 is exposed, the propellants are supplied to the rocket 14 from the propellant supply ship lying alongside the rocket, and then the carrier 4 or the block house disposed on the vehicle assembly building platform 2 instructs to launch the rocket 14.

Description will now be made of the process after the rocket has been launched. After the rocket has been launched, the pad service tower 7 of the launch pad platform 1 is closed, and the launch pad platform 1 is released from the mooring, floated, transported to the carrier 4 by the tug boat 5, and then floated on the carrier 4. Then, the pad service tower 7 is opened and the mobile launcher 10 on which the launching has been completed is parked in the turnount provided on the launch pad platform 1. Then, another mobile launcher 10 on which the rocket 14 of the second launching which has been serviced on the vehicle assembly building platform 2 and fitted with solid rockets 15 is moved to the launch pad and set thereon. The mobile launcher 10 of the first launching which is parked in the turnout is returned to the mobile launcher parking lot of the vehicle assembly building platform 2. Then, the second launching is performed by the process of the first launching and a rocket 14 of the third launching is successively launched in the same manner as the above. The carrier 4 on which all the processes have been completed, loaded with all the platforms 1, 2, and 3, starts on the return voyage. However, when three or more rockets 14 are continuously launched, a required number of additional vehicle hangar platforms 3 are provided and transported from the rocket manufactory to the launching ocean area by another carrier which is capable of loading and unloading the additional platforms 3 by the float on/float off method.

In the above-mentioned embodiment, a dry tow is conducted by the carrier 4 which is capable of loading and unloading all the platforms 1, 2, 3 by the float on/-float off method. However, it is possible to transport the platforms to the launching ocean area from the loading berth 16 by the tug boat 5 in a wet tow manner, without using the carrier. In this case, a non-propelled floating dock type operation base 404 can be used for moving the ML 10 between each of the platforms 1, 2, and 3 in the launching ocean area in place of the carrier. In addition, in the above-described embodiment, the rocket 14 is stored in the state of laying on the vehicle hangar platform 3 and transported in this state. However, a rocket 14 which has been shipped in a standing state may stored as it is, transported to the launching ocean area from the manufactory by a particular carrier which produces little shaking, and moved onto the mobile launcher 10 to be set. Furthermore, two or more launch pad platforms 2 may be provided and used alternately for launching so that it is possible to reduce the interval required for servicing the body of the launch pad platform 1 after launching and increase the annual frequency of launching.

What is claimed is:

1. An ocean launching apparatus for space rockets comprising:

(a) a launch pad platform having a floating-island structure for launching at least one rocket;

(b) a vehicle assembly building platform having a floating-island structure for servicing the rocket before launching;

(c) a carriage for carrying said rocket serviced in the vehicle assembly building platform to the launch pad platform;

(d) a hull having a semi-submersible structure adapted for ocean transportation of the launch pad platform and the vehicle assembly building platform, for loading and unloading of said platforms by a float-on/float-off method, and to serve as a floating foundation to keep said platforms in a line for combination work on the ocean.

2. An ocean launching apparatus for space rockets according to claim 1, wherein the apparatus further comprises:

at least one vehicle hangar platform having a floating-island structure for safely maintaining at least one rocket during transportation; and means for transferring the rocket from the vehicle hangar platform to the vehicle assembly building platform.

3. An ocean launching apparatus for space rockets according to claim 2, wherein the vehicle hangar platform comprises a main deck, two web-formed struts projecting from the lower portion of the main deck, and a pontoon float fixed at the lower ends of the struts.

4. An ocean launching apparatus for space rockets according to claim 3, wherein the discharging means for transferring the rocket from the vehicle hangar platform to the vehicle assembly building platform comprises a crane.

5. An ocean launching apparatus for space rockets according to claim 1, wherein:

the launch pad platform comprises a main deck, a plurality of struts projecting from the lower portion of the main deck, and two pontoon floats fixed at the lower portion of the struts;

the vehicle assembly building platform comprises a main deck, a plurality of web-formed struts projecting from the lower portion of the main deck, and a pontoon float fixed at the lower ends of the struts; and wherein the main deck of said launch pad platform and the main deck of the vehicle assembly building platform attain the same level when the launch pad platform and the vehicle assembly building platform are loaded on the hull.

6. An ocean launching apparatus for space rockets according to claim 2, comprising at least one tug boat loaded on said hull for effecting float-on/float-off operation of the launch pad platform and for moving and positioning the launch pad platform to an optimum position for launching.

7. An ocean launching apparatus for space rockets according to claim 6, further comprising a tunnel beneath the vehicle hangar platform for storage of said tug boat.

8. An ocean launching apparatus for space rockets according to claim 6, further comprising at least one additional boat loaded on the hull for embarking workers between the hull and the launch pad platform.

9. An ocean launching apparatus for space rockets according to claim 8, further comprising a tunnel at the under portion of said vehicle assembly building platform for securing the second boat.

10. A method for launching space rockets at an optimum position on the ocean comprising the steps of:

preparing a launch pad platform for launching rockets, said platform having a floating-island structure;

preparing a vehicle assembly building platform for servicing at least one rocket before launching, said platform having a floating-island structure;

preparing at least one vehicle hangar platform for safely maintaining at least one rocket during transportation, said platform having a floating-island structure;

loading at least one rocket on the vehicle hangar platform at a rocket manufacturing site;

loading said launch pad platform, vehicle assembly platform, and vehicle hangar platform with said rocket, onto a carrier by a float-on method in a loading area;

loading at least one boat onto the carrier by a float-on method;

sailing the carrier to an intended ocean area;

floating off said boat from said carrier at said intended ocean area;

transferring the rocket from the vehicle hangar platform to the vehicle assembly building platform;

setting the rocket on a mobile launcher in the vehicle assembly building platform;

transferring the mobile launcher with rocket from the vehicle assembly building platform to the launch pad platform;

floating off the launch pad platform from the carrier;

transporting the launch pad platform by means of the boat to an intended launching position;

positioning the launch pad platform at the launching position; and launching the rocket from the launch pad platform.

* * * * *